US006713222B2

(12) United States Patent
Sacripante et al.

(10) Patent No.: US 6,713,222 B2
(45) Date of Patent: Mar. 30, 2004

(54) CURING PROCESSES

(75) Inventors: Guerino G. Sacripante, Oakville (CA); Edward J. Gutman, Webster, NY (US)

(73) Assignee: Xerox Corporation, Stamford, CT (US)

( * ) Notice: Subject to any disclaimer, the term of this patent is extended or adjusted under 35 U.S.C. 154(b) by 44 days.

(21) Appl. No.: 10/084,122

(22) Filed: Feb. 28, 2002

(65) Prior Publication Data

US 2003/0162110 A1 Aug. 28, 2003

(51) Int. Cl.[7] ..... G03G 13/20

(52) U.S. Cl. ..... 430/124; 399/336; 430/110.2; 430/97

(58) Field of Search ..... 430/97, 124; 399/336

(56) References Cited

U.S. PATENT DOCUMENTS

| | | | | |
|---|---|---|---|---|
| 4,110,187 A | | 8/1978 | Sloan et al. | 204/159.19 |
| 4,129,488 A | | 12/1978 | McGinniss | 204/159.19 |
| 5,049,646 A | | 9/1991 | Tyagi et al. | 528/272 |
| 5,102,762 A | | 4/1992 | Tyagi et al. | 430/109 |
| 5,227,460 A | | 7/1993 | Mahabadi et al. | 528/272 |
| 5,275,918 A | | 1/1994 | Held et al. | 430/291 |
| 5,948,594 A | | 9/1999 | Dudek et al. | 430/273.1 |
| 5,972,565 A | | 10/1999 | Dudek et al. | 430/287.1 |
| 6,025,409 A | * | 2/2000 | Jansen | 522/107 |
| 6,461,782 B1 | * | 10/2002 | Sasada et al. | 430/124 |
| 2002/0090238 A1 | * | 7/2002 | Bartscher e al. | 399/336 |
| 2002/0141791 A1 | * | 10/2002 | Rohde et al. | 399/336 |

FOREIGN PATENT DOCUMENTS

| | | | | |
|---|---|---|---|---|
| EP | 823670 A1 | * | 2/1998 | G03G/8/00 |
| WO | WO 9946645 A1 | * | 9/1999 | G03G/9/87 |

OTHER PUBLICATIONS

Chemical Abstracts Regsitry No. 947–19–3.*

* cited by examiner

*Primary Examiner*—Christopher Rodee
(74) *Attorney, Agent, or Firm*—Fay, Sharpe, Fagan, Minnich & McKee, LLP

(57) ABSTRACT

A process for crosslinking an image comprising applying ultraviolet light to an image comprised of a toner containing an unsaturated resin and colorant.

21 Claims, No Drawings

CURING PROCESSES

BACKGROUND

The present invention is generally directed to processes for hardening toner based xerographic images for use in packaging media. In embodiments, the present invention is directed to the ultraviolet light assisted post curing of xerographic images comprised of xerographic toners wherein the toners are comprised of, for example, an unsaturated resin, colorant and various additives to thereby render the images with anti-offset properties when heat and pressure is applied, such as in packaging applications. In a specific embodiment of the present invention, the post ultraviolet light assisted curing results in the crosslinking of the toner image thereby resulting in an improved hot-offset performance, such as from about 180° C. to 240° C., and high toner elasticity, such as from about 106 poise to about 108 poise at a temperature of from about 180° C. to about 200° C., as measured by thermometer at a shear frequency of from about 10 to about 100 radian per second, and which cured crosslinked toner images are useful in packaging applications wherein xerographic images on a variety of substrates can then be heat sealed onto containers, such as plastic bottles, and the like. A xerographic engine can be utilized in marking images on, for instance, an aluminum foil substrate with a toner comprised of an unsaturated resin, colorant and toner additives fused by either a contact or non-contact fuser. These images are then hardened by exposure to ultraviolet light causing the unsaturated resin in the toner to be crosslinked, and whenever the hardened images can then be heat and pressure sealed onto containers, such as for example, pharmaceutical bottles, food containers such as yogurt cups and the like, without or minimal image offset, or transported onto pressure sealing devices. An overcoating lacquer comprised of an ultraviolet initiator and optionally an unsaturated monomer can be applied or coated onto the xerographic image, followed by the application of ultraviolet light to harden the image on a substrate like paper.

REFERENCES

Electrophotographic toners are generally comprised of a resin, such as a styrene-acrylate or polyester, a colorant and optionally a charge control agent. Many various toner formulations are known, and more specifically, one toner formulation is comprised of an unsaturated polyester resin, such that desirable low fixing temperatures and offset properties are attained, reference, for example, U.S. Pat. No. 5,227,460, the disclosure of which is totally incorporated herein by reference, and wherein there is illustrated the unsaturated polyester resin poly(propoxylated bisphenol co-fumarate) which is branched to a gel content of up to about 40 weight percent utilizing a peroxide to provide a toner useful for electrophotographic processes.

In U.S. Pat. No. 3,590,000, an unsaturated polyester for use as a toner binder is disclosed. Similarly, in U.S. Pat. No. 4,331,755, there is disclosed an unsaturated polyester resin derived from fumaric acid and a polyol blend of propoxylated bisphenol. Additionally, U.S. Pat. No. 4,525,445, discloses an unsaturated polyester resin derived from fumaric acid, isophthalic acid and a polyol blend of propoxylated bisphenol. The aforementioned unsaturated polyester resins can be utilized, for example, as a toner binder, especially for xerographic copiers and printers. Other patents of that may be of interest are U.S. Pat. Nos. 4,788,122; 5,466,554, 5,686,218; 4,988,794; 4,727,011; 4,533,614 and 5,366,841.

The disclosures of all the patents are totally incorporated herein by reference.

Ultraviolet-hardenable printing inks for use in flexographic printing forms are disclosed in U.S. Pat. Nos. 5,948,594 and 5,972,565, the disclosures of which are totally incorporated herein by reference, and wherein a photopolymerizable printing plate and ultraviolet printing inks are disclosed. Ultraviolet curable epoxy-polyester powder paints are disclosed in U.S. Pat. No. 4,129,488, the disclosure of which is totally incorporated herein by reference, wherein there is illustrated powder paint coatings comprised of ethylenically unsaturated polymers.

U.S. Pat. No. 5,275,918, the disclosure of which is totally incorporated herein by reference, discloses an ultraviolet curable heat activatable transfer toner, and more specifically, a nonelectroscopic prolonged toner comprising (i) an ultraviolet curable, epoxy-containing, copolymer comprising a first monomer and a second monomer wherein the second monomer is selected from the group consisting of glycidyl methacrylate and glycidyl acrylate, and wherein the copolymer possesses an average molecular of about 100 to about 10,000 and is present in an amount of about 10 to about 50 percent by weight based on the total toner weight; (ii) a solid plasticizer present in an amount of from about 50 to about 90 percent by weight based on the total toner weight; and (iii) a photoinitiator present in an amount of about 0.5 to about 15 percent by weight based on the total toner.

In U.S. Pat. No. 4,110,187, the disclosure of which is totally incorporated herein by reference, there is illustrated, for example, a radiation composition of a solution of a polyester resin and a solvent containing an ethylenic unsaturated photopolymerizable compound.

In U.S. Pat. Nos. 5,049,646 and 5,102,762, the disclosures of which are totally incorporated herein by reference, there are disclosed polyesters and ultraviolet toners thereof wherein the toner particles are useful in photolithographic applications and wherein ultraviolet light is used for generating printing plates from color separation transparencies which contain imaged areas defined by the toner particles.

In a number of xerographic engines and processes, the toner image is fused on a substrate, such as paper or a transparency, by heating the toner with a contact fuser or a non-contact fuser, and wherein the transferred heat melts the toner mixture onto the substrate. When a resin is highly branched or crosslinked, such as about 40 to about 65 percent, higher temperatures can be used to melt the toner mixture, and in some instances, when the crosslinking level is too high, then the toner mixture usually will not melt and may even decompose before melting. Thus, to retain the energy of the xerographic engine to a minimum, such as at a low fusing temperature of from about 125° C. to about 145° C., it is desirable to utilize low, for example toners which fuse at from about 125° C. to about 145° C., and wherein less heat is utilized during the fusing of the image on paper. However, such low melting toner mixtures may not be as effective for use in packaging, especially wherein heat and pressure devices are utilized to seal these substrate images onto packages. Hence a process is needed to overcome this disadvantage, and more specifically, a method or process wherein a low melting toner is utilized to generate a xerographic image, and wherein the xerographic image is hardened on the substrate by, for example, use of an ultraviolet light source, and also wherein an overcoating lacquer may be included on the substrate, which lacquer can be comprised of an ultraviolet initiator and/or unsaturated monomers, causing the unsaturated resin in the toner to crosslink and which enables its effective use in packaging applications wherein heat and pressure devices are utilized to seal the xerographic image substrate on various packaging containers.

SUMMARY

It is a feature of the present invention to provide processes utilizing a low melting toner comprised of an unsaturated resin, colorant and toner additives.

It is another feature of the present invention to provide xerographic images on a variety of substrates, such as paper, MYLAR® or an aluminum foil, and wherein the xerographic image is comprised of a toner comprised of an unsaturated resin and colorant.

In yet another feature of the present invention, there are provided processes for hardening xerographic images, such as by ultraviolet light, which enables the toner resin to crosslink.

Moreover, it is a feature of the present invention to provide methods of hardening xerographic images by first generating an image by a xerographic process, fusing the image on a substrate by contact or non-contact fusing, followed by an ultraviolet light assisted curing of the image, and wherein the toner image is hardened by a crosslinking process induced by the ultraviolet light.

Furthermore, it is a feature of the present invention to provide methods of hardening xerographic images by first obtaining an image by a xerographic process wherein the image is fused on the substrate by a contact or a non-contact fuser, followed by applying an overlaquer coating on the image, such as a lacquer comprised of an ultraviolet initiator, and optionally an unsaturated monomer and vehicle, followed by curing the image with an ultraviolet light, and wherein the toner image is hardened by a crosslinking process induced by the ultraviolet light.

These and other features of the present invention are provided in embodiments of the present invention, and more specifically, there are provided processes for hardening toner based xerographic images for use in packaging media, and wherein there is accomplished an ultraviolet light assisted post curing of the images comprised of xerographic toners comprised of an unsaturated resin and colorant thereby providing the images with anti-offset properties when heat and pressure sealing is applied, such as in packaging applications.

Aspects of the present invention relate to a process for crosslinking an image comprising applying ultraviolet light to an image comprised of a toner containing an unsaturated resin and colorant; a process wherein the unsaturated resin is poly(propoxylated bisphenol-fumarate), poly(ethoxylated bisphenol-fumarate), poly(butyloxylated bisphenol-fumarate), poly(propoxylated bisphenol-maleate), poly (ethoxylated bisphenol-maleate), poly(butyloxylated bisphenol-maleate), copoly(diethylene-propylene terephthalate)-copoly(diethylene-propylene fumarate), copoly(propylene-terephthalate)-copoly(propylene-fumarate), copoly(diethylene-propylene terephthalate)-copoly(diethylene-propylene maleate), copoly(propylene-terephthalate)-copoly(propylene-maleate), or mixtures thereof; a process wherein the colorant is a pigment of black, cyan, magenta, yellow, green, orange, violet, blue, red, purple, white or silver; a process wherein the light image contains an overcoating lacquer comprised of an ultraviolet initiator and optionally an unsaturated monomer; a process wherein the unsaturated monomer is present and is methyl acrylate, methyl methacrylate, ethyl acrylate, ethyl methacrylate, propyl acrylate, propyl methacrylate, butyl acrylate, butyl methacrylate, hexyl acrylate, hexyl methacrylate, pentyl acrylate, pentyl methacrylate, heptyl acrylate, heptyl methacrylate, octyl acrylate, octyl methacrylate, nonyl acrylate, nonyl methacrylate, decylacrylate, decylmethacrylate, lauryl acrylate, lauryl methacrylate, stearyl acrylate, stearyl methacrylate, dodecyl acrylate, dodecyl methacrylate, or polyethylene glycol methacrylate; a process wherein the ultraviolet initiator is selected from the group consisting of benzoin ethers, acetophenone derivatives such as 2,2-dimethoxy-2-phenyl acetophenone, 2-hydroxy-2-methyl-1-phenylpropan-1-one, 2,2,2-trichloroacetophenone and the like. Suitable hydrogen abstraction type a initiators include benzophenone and derivatives thereof, anthraquinone, 4,4'-bis(dimethylamino) benzophenone, thioxanthone with quinoline sulfonylchloride, 2,4,6-trimethylbenzoyl-diphenyl-phosphine oxide, (2-methyl-1-[4-(methylthio)phenyl]-2-morpholinopropane-1-one), (hydroxycyclohexyl)phenyl ketone, (2-benzyl-2-N-dimethylamino-1-(4-morpholinophenyl)-1-butanone), (benzyl dimethyl ketal), 2-(carbamoylazo)-substituted, 2-n-propoxy-9H-thioxanthen-9-one and ethyl 4-(dimethylamino)benzoate; a process wherein the image is a xerographic image; a process wherein the unsaturated resin is a polyester; a process wherein the polyester is a poly(alkoxyalkylated)bisphenol; a process wherein the colorant is a pigment; a process wherein the toner image is generated by a xerographic process; a process wherein the toner image is generated by a digital imaging process; a process wherein the crosslinking or gel amount is from about 40 to about 70 percent and wherein the unsaturated resin is crosslinked after exposure to ultraviolet light; a process wherein the ultraviolet light possesses a wavelength of from about 250 to about 550 nanometers; a process wherein the wavelength is from about 320 to about 500 nanometers; a process wherein the unsaturated resin is present in an amount of from about 75 to about 95 weight percent; a process wherein the resin is present in an amount of from about 80 to about 90 weight percent; a process wherein the colorant is present in an amount of from about 5 to about 15 weight percent; a process wherein the applying is accomplished by a suitable light source, and which applying is for a period of from about 1 second to about 1 minute; a process wherein the overcoating is of a thickness of from about 1 micron to about 5 microns; a process wherein the initiator is selected in an amount of from about 1 to about 10 weight percent based on the toner components, and wherein said unsaturated resin is selected in an amount of from about 35 to about 50 weight percent; a process wherein the unsaturated resin is a polyester resin; a process wherein the initiator is 2,2-dimethoxy-2-phenyl acetophenone; a process for crosslinking an image comprising applying ultraviolet light to an image comprised of a toner containing an unsaturated resin and colorant, and wherein the toner image contains an overcoating lacquer comprised of an ultraviolet light initiator and an unsaturated monomer.

Examples of unsaturated polyester resins are a poly (propoxylated bisphenol-fumarate), poly(ethoxylated bisphenol-fumarate), poly(butyloxylated bisphenol-fumarate), poly(propoxylated bisphenol-maleate), poly (ethoxylated bisphenol-maleate), poly(butyloxylated bisphenol-maleate), copoly(diethylene-propylene terephthalate)-copoly (diethylene-propylene fumarate), copoly(propylene-terephthalate)-copoly(propylene-fumarate), copoly(diethylene-propylene terephthalate)-copoly(diethylene-propylene maleate), copoly(propylene-terephthalate)-copoly(propylene-maleate), mixtures thereof, and the like.

The polyester resin, unsaturated in embodiments, possesses a number average molecular weight ($M_n$), as measured by gel permeation chromatography (GPC), of from about 1,000 to about 20,000, and more specifically, from about 2,000 to about 50,000, and a weight average molecular weight ($M_w$) of typically from about 2,000 to about 40,000, and more specifically, from about 4,000 to about 150,000, with the molecular weight distribution ($M_w/M_n$) of the resin being typically from about 1.5 to about 6, and more specifically, from about 2 to about 4. The onset glass transition temperature (Tg) of the resin as measured by differential scanning calorimeter (DSC) in embodiments is, for example, from about 50° C. to about 70° C., and more specifically, from about 52° C. to about 65° C. Melt viscosity of the toner resin as measured with a mechanical spectrometer at 10 radians per second can be, for example, from about 5,000 to about 200,000 poise, and more specifically, from about 20,000 to about 100,000 poise at 100° C. and which viscosity decreases with increasing temperature to, for example, from about 100 to about 5,000 poise, and more specifically, from about 400 to about 2,000 poise, as the temperature increases from, for example, about 100° C. to about 130° C.

Various known suitable colorants, such as dyes, pigments, and mixtures thereof and present in the toner in an effective amount of, for example, from about 1 to about 25 percent by weight of the toner, and more specifically, in an amount of from about 2 to about 12 weight percent, include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E. I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2GO1 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Various known suitable effective positive or negative charge enhancing additives can be selected for optional incorporation into the toner compositions in an amount of about 0.1 to about 10, more specifically about 1 to about 3 percent by weight. Examples of additives include quaternary ammonium compounds inclusive of alkyl pyridinium halides; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); and the like.

There can also be blended with the toner compositions other toner additives, such as external additive particles including flow aid additives, which additives are usually present on the toner surface thereof. Examples of these additives include metal oxides like titanium oxide, tin oxide, mixtures thereof, and the like, colloidal silicas, such as AEROSIL®, metal salts and metal salts of fatty acids inclusive of zinc stearate, aluminum oxides, cerium oxides, and mixtures thereof, which additives are each generally present in an amount of from about 0.1 percent by weight to about 5 percent by weight, and more specifically, in an amount of from about 0.1 percent by weight to about 1 percent by weight. Several of the aforementioned additives are illustrated in U.S. Pat. No. 3,590,000 and 3,800,588, the disclosures which are totally incorporated herein by reference. Also, there can be selected as additives the coated silicas of U.S. Pat. Nos. 6,004,714; 6,190,815 and 6,214,507, the disclosures of which are totally incorporated herein by reference.

Overcoating lacquers can be applied to the xerographic images prior to post curing with ultraviolet light. Examples of lacquer compositions include a mixture of a solvent, unsaturated monomer and an ultraviolet initiator.

Examples of solvents selected in various amounts, such as for example, from about 10 to about 90 percent, and more specifically, from about 20 to about 50 percent by weight includes water, ethylactete, acetone, methylethyl ketone, N-methylpyrrolidinone, sulfolane, trimethylopropane, alkylene glycols, such as ethylene glycol, propylene glycol, diethylene glycols, glycerine, dipropylene glycols, polyethylene glycols, polypropylene glycols, amides such as acetamide, ethers such as ethyl either or diethyl ether carboxylic acids such as acetic acid, ethanoic acid, propanoic acid ethers, such as ethyl acetate, methyl acetate, propyl acetate, alcohols such as methanol, ethanol, propanol and butanol, organosulfides, organosulfoxides, sulfones, dimethylsulfoxide, alcohol derivatives, carbitol, butyl carbitol, cellusolve, ether derivatives, amino alcohols and ketones.

Examples of unsaturated monomers that can be utilized in the lacquer mixture include acrylates, such as methyl acrylate, methyl methacrylate, ethyl acrylate, ethyl methacrylate, propyl acrylate, propyl methacrylate, butyl acrylate, butyl methacrylate, hexyl acrylate, hexyl methacrylate, pentyl acrylate, pentyl methacrylate, heptyl acrylate, heptyl methacrylate, octyl acrylate, octyl methacrylate, nonyl acrylate, nonyl methacrylate, decylacrylate, decylmethacrylate, lauryl acrylate, lauryl methacrylate, stearyl acrylate, stearyl methacrylate, dodecyl acrylate, dodecyl methacrylate, or polyethylene glycol methacrylate; nonacrylates, such as styrene, methyl styrene, vinyl styrene, and the like.

Examples of ultraviolet initiators selected, for example, in an amount of from about 0.5 to about 15 percent, about 0.5 to about 10, about 1 to about 5, and from about 2 to about 5 percent that can be utilized in the lacquer mixture include light (ultraviolet or visible) with wavelengths of, for example, from about 250 to about 550 nanometers, and more specifically about 320 to 500 about nanometers of photoinitiator materials which undergo fragmentation upon irradiation, hydrogen abstraction type initiators, and donor-acceptor complexes. Suitable photofragmentation initiators include, but are not limited to, those selected from the group consisting of benzoin ethers, acetophenone derivatives such as 2,2-dimethoxy-2-phenyl acetophenone, 2-hydroxy-2-methyl-1-phenylpropan-1-one, 2,2,2-trichloroacetophenone and the like. Suitable hydrogen abstraction type initiators include benzophenone and derivatives thereof, anthraquinone, 4,4'-bis(dimethylamino)benzophenone (Michler's ketone) and the like. Suitable donor-acceptor complexes include combinations of donors, such as triethanolamine, with acceptors such as benzophenone. Also suitable are sensitizers or initiators, such as thioxanthone with quinoline sulfonylchloride; 2,4,6-trimethylbenzoyl diphenylphosphine oxide, (2-methyl-1-[4-(methylthio) phenyl]-2-morpholinopropane-1-one), (hydroxycyclohexyl) phenyl ketone, (2-benzyl-2-N-dimethylamino-1-(4-morpholinophenyl)-1-butanone), (benzyl dimethyl ketal), 2-(carbamoylazo)-substituted, 2-n-propoxy-9H-thioxanthen-9-one and ethyl 4-(dimethylamino)benzoate, and the like.

The following Examples are being provided to further illustrate various species of the present invention, it being noted that these Examples are intended to illustrate and not limit the scope of the present invention.

| | |
|---|---|
| Lamp: | High Pressure 100 Watt Mercury Vapor Short Arc |
| Lamp Life: | 1,000 hours (typical) |
| Removable Filters: | Standard: 320 to 500 nanometers (nm)<br>Optional: 250 to 450 nm*, 365 nm, 320 to 390 nm, 400 to 500 nm |

*Must be used with extended range or fused silica light guides.

EXAMPLE I

A UV box apparatus fitted with a hot plate, a high pressure U.S. light 100 watt mercury vapor short arc with a standard 320 to 500 nanometer filter, available from Efos Corporation, was set up equipped with a radiometer for measuring the UV power and an IR detector for controlling the hot plate temperature. Three separate samples, each about 2 grams, comprised of 2 grams of cyan toner comprised of 97 percent by weight of poly(propoxylated bisphenol A-fumarate) and 3 percent of cyan 15:3 pigment were mixed with 5 percent of the UV initiator, isopropyl-9H-thioxanthen-9-one (ITO). These separate samples were then heated independently at three different temperatures (120° C., 160° C. and 200° C.). A UV lamp delivering about 2 millijoules/minute was irradiated on the samples until up to about 800 millijoules was delivered by the lamp. The toners were then analyzed rheologically (dynamically at 1 Hz).

The rheological properties of the toner before exposure to ultraviolet light indicates a melt viscosity as measured with a mechanical spectrometer at 10 radians per second of from about 5,000 to about 200,000 poise at 100° C., and which melt viscosity drops sharply with increasing temperature to from about 100 to about 5,000 poise as the temperature rises from about 100° C. to about 170° C. The elasticity component of the toner resin display about 1,000 pascal to about 10,000 pascal at 100° C., and drops sharply to about 100 to about 1000 pascal at about 170° C. After exposure to ultraviolet light, it is believed that the resin crosslinks via the unsaturated moieties, and thus an increase in both viscosity and elasticity of the resin results. The increase in viscosity as measured with a mechanical spectrometer at 10 radians per second of from about 20,000 to about 500,000 poise at 100° C., and said melt viscosity drops sharply with increasing temperature to from about 1,000 to about 20,000 poise as the temperature rises from about 100° C. to about 170° C. The elasticity component of the toner resin displays about 8,000 pascal to about 100,000 pascal at about 100° C., and drops sharply to about 5,000 to about 80,000 pascal at about 170° C.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for crosslinking an image comprising applying ultraviolet light to an image comprised of a toner containing an unsaturated resin in an amount of from about 35 to about 50 weight percent, and colorant, and an overcoating lacquer including an ultraviolet initiator in an amount of from about 1 to about 10 weight percent based on the toner components.

2. A process in accordance with claim 1 wherein the unsaturated resin is poly(propoxylated bisphenol-fumarate), poly(ethoxylated bisphenol-fumarate), poly(butyloxylated bisphenol-fumarate), poly(propoxylated bisphenol-maleate), poly(ethoxylated bisphenol-maleate), poly (butyloxylated bisphenol-maleate), copoly(diethylene-propylene terephthalate)-copoly(diethylene-propylene fumarate), copoly(propylene-terephthalate)-copoly (propylene-fumarate), copoly(diethylene-propylene terephthalate)-copoly(diethylene-propylene maleate), copoly(propylene-terephthalate)-copoly(propylene-maleate), or mixtures thereof.

3. A process in accordance with claim 1 wherein the colorant is a pigment of black, cyan, magenta, yellow, green, orange, violet, blue, red, purple, white or silver.

4. A process in accordance with claim 1 wherein the overcoating lacquer further comprises an unsaturated monomer.

5. A process in accordance with claim 4 wherein the unsaturated monomer is selected from the group consisting of methyl acrylate, methyl methacrylate, ethyl acrylate, ethyl methacrylate, propyl acrylate, propyl methacrylate, butyl acrylate, butyl methacrylate, hexyl acrylate, hexyl methacrylate, pentyl acrylate, pentyl methacrylate, heptyl acrylate, heptyl methacrylate, octyl acrylate, octyl methacrylate, nonyl acrylate, nonyl methacrylate, decylacrylate, decylmethacrylate, lauryl acrylate, lauryl methacrylate, stearyl acrylate, stearyl methacrylate, dodecyl acrylate, dodecyl methacrylate, and polyethylene glycol methacrylate.

6. A process in accordance with claim 4 wherein said overcoating is of a thickness of from about 1 micron to about 5 microns.

7. A process in accordance with claim 4 wherein said initiator is 2,2-dimethoxy-2-phenyl acetophenone.

8. A process in accordance with claim 1 wherein the ultraviolet initiator is selected from the group consisting of benzoin ethers and acetophenone derivatives selected from the group consisting of 2,2-dimethoxy-2-phenyl acetophenone, 2-hydroxy-2-methyl-1-phenylpropan-1-one, and 2,2,2-trichloroacetophenone.

9. A process in accordance with claim 1 wherein the image is a xerographic image.

10. A process in accordance with claim 1 wherein the unsaturated resin is a polyester.

11. A process in accordance with claim 10 wherein the polyester is a poly(alkoxyalkylated) bisphenol.

12. A process in accordance with claim 10 wherein said polyester is poly(propoxylated bisphenol fumarate).

13. A process in accordance with claim 1 wherein the colorant is a pigment.

14. A process in accordance with claim 1 wherein the toner image is generated by a xerographic process.

15. A process in accordance with claim 1 wherein the toner image is generated by a digital imaging process.

16. A process in accordance with claim 1 wherein the crosslinking or gel amount of the resin is from about 40 percent to about 70 percent after exposure to ultra-violet light, and wherein said unsaturated resin is crosslinked after exposure to ultraviolet light.

17. A process in accordance with claim 16 wherein said wavelength is from about 320 to about 500 nanometers.

18. A process in accordance with claim 1 wherein said ultraviolet light possesses a wavelength of from about 250 to about 550 nanometers.

19. A process in accordance with claim 1 wherein said colorant is present in an amount of from about 5 to about 15 weight percent.

20. A process in accordance with claim 1 wherein said applying is accomplished by a suitable light source, and which applying is for a period of from about 1 second to about 1 minute.

21. A process in accordance with claim 1 wherein said UV initiator is benzophenone and derivatives thereof, anthraquinone, 4,4'-bis(dimethylamino) benzophenone, thioxanthone with quinoline sulfonylchloride, 2,4,6-trimethylbenzoyl-diphenyl-phosphine oxide, (2-methyl-1-[4-(methylthio) phenyl]-2-morpholinopropane-1-one), (hydroxycyclohexyl) phenyl ketone, (2-benzyl-2-N-dimethylamino-1-(4-morpholinophenyl)-1-butanone), (benzyl dimethyl ketal), 2-(carbamoylazo)-substituted, 2-n-propoxy-9H-thioxanthen-9-one and ethyl 4-(dimethylamino)benzoate.

* * * * *